US011011128B1

(12) United States Patent
Gao

(10) Patent No.: US 11,011,128 B1
(45) Date of Patent: May 18, 2021

(54) GOA CIRCUIT DRIVING METHOD AND DRIVING DEVICE

(71) Applicant: Shenzhen China Star Optoelectronics Technology Co., Ltd., Shenzhen (CN)

(72) Inventor: Xiang Gao, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 337 days.

(21) Appl. No.: 16/319,818

(22) PCT Filed: Sep. 27, 2018

(86) PCT No.: PCT/CN2018/107820
§ 371 (c)(1),
(2) Date: Jan. 22, 2019

(87) PCT Pub. No.: WO2020/015179
PCT Pub. Date: Jan. 23, 2020

(30) Foreign Application Priority Data

Jul. 17, 2018 (CN) ..... 201810786068.5

(51) Int. Cl.
*G09G 3/36* (2006.01)

(52) U.S. Cl.
CPC ... *G09G 3/3677* (2013.01); *G09G 2300/0842* (2013.01); *G09G 2300/0871* (2013.01); *G09G 2310/0289* (2013.01); *G09G 2310/08* (2013.01); *G09G 2320/0219* (2013.01); *G09G 2330/021* (2013.01)

(58) Field of Classification Search
CPC ..... G09G 3/3677; G09G 2300/0842; G09G 2300/0871; G09G 2310/0289; G09G 2310/08; G09G 2320/0219; G09G 2330/021
See application file for complete search history.

(56) References Cited

U.S. PATENT DOCUMENTS 5,912,574 A 6/1999 Bhagwan
2010/0315322 A1* 12/2010 Cheng ..... G09G 3/3677 345/99
2011/0169723 A1* 7/2011 Hsu ..... H03K 19/0175 345/100

(Continued)

FOREIGN PATENT DOCUMENTS

CN 101853643 A 10/2010
CN 101950526 A 1/2011

(Continued)

*Primary Examiner* — Stephen G Sherman
(74) *Attorney, Agent, or Firm* — Leong C. Lei

(57) ABSTRACT

The present invention teaches a GOA circuit driving method and a GOA circuit driving device. Through the configuration of a buffer capacitor electrically connected to the level shift IC, the level shift IC connects to the buffer capacitor and switches to the transition level during shifting the target clock signals from high to low level or from low to high level. Through the buffer capacitor, the present invention is able to keep the transition level always equal to one half of the sum of the low voltage and the high voltage, thereby maximizing reduction of power consumption and feed-through effect of the GOA circuit.

10 Claims, 5 Drawing Sheets

(56) References Cited

U.S. PATENT DOCUMENTS

| | | | | |
|---|---|---|---|---|
| 2013/0249781 | A1* | 9/2013 | Park | G09G 3/3688 345/99 |
| 2017/0337862 | A1* | 11/2017 | Geng | G06F 3/04166 |

FOREIGN PATENT DOCUMENTS

| | | | |
|---|---|---|---|
| CN | 101950520 | B | 12/2012 |
| CN | 104680991 | A | 6/2015 |
| CN | 107516500 | A | 12/2017 |

* cited by examiner

GOA CIRCUIT DRIVING METHOD AND DRIVING DEVICE

FIELD OF THE INVENTION

The present invention is generally related to the field of display technology, and more particularly to a driving method and a driving device to a Gate Drive on Array (GOA) circuit.

BACKGROUND OF THE INVENTION

Active Matrix Liquid Crystal Displays (AMLCDs) are currently most common display devices. An AMLCD includes multiple pixels, each having a Thin Film Transistor (TFT) whose gate is connected to a scan line extended along a lateral direction, whose source is connected to a data line extended along a vertical direction, and whose drain is connected a corresponding pixel electrode. By applying appropriate voltage to a scan line, all TFTs connected to the scan line are turned on and data signals on the data lines are written into the pixel electrodes, thereby showing an image.

A type of display panel using AMLCD has the Gate Drive on Array (GOA) structure where Gate Drive IC is integrated on the TFT array substrate so as to achieve the line-by-line scanning to the display panel. Compared to the prior art that has the Integrated Circuit (IC) outside the display panel, the GOA structure is able to reduce manufacturing processes and costs, to enhance the integrity of the display panel, and to facilitate the fulfillment of thin and narrow-bezel display panel.

The GOA structure however requires a Level Shift IC configured on a circuit board external to the display panel for conducting level shifting to clock signals from the timing controller and providing the level-shifted clock signals to the GOA circuit so as to drive the GOA circuit to function. As shown in FIG. 1, an existing GOA circuit driving device usually includes a timing controller 100 and a level shift IC 200 electrically connected to the timing controller 100. The timing controller 100 produces and transmits a clock signal CKV. The level shift IC 200 is connected to a high voltage source VGH and a low voltage source VGL, and switches the high and low levels of the clock signal CKV from the timing controller 100 respectively to the high voltage source VGH and the low voltage source VGL. The level-shifted clock signal CKV' is then provided to the GOA circuit so as to drive the GOA circuit to function. For example, as shown in FIG. 2, the clock signal CKV from the timing controller 100 has a high level of 3.3V and a low level of 0V. After the level shifting by the level shift IC 200, the clock signal CKV' has a high level of 33V and a low level of −10V. Periods and pulse widths of the clock signal remain the same before and after level shifting.

As shown in FIG. 2, the clock signal CKV' from the conventional level shift IC 200 has only two states of high (33V) and low (−10V) levels. As the dimension and resolution of LCD panel increase, the GOA circuit involves more stages. The two-state clock signal CKV' leads to high power consumption and obvious feedthrough effect from the GOA circuit. To resolve these problems, a solution teaches a Charge Sharing technique that short-circuits a high-level clock signal with a low-level clock signal so as to produce a transition level. This solution however is applicable only to clock signals with 50% duty ratio. Another solution therefore teaches that the level shift IC 200 is further connected to a transition level voltage. When the clock signal CKV' is switched from high to low or from low to high level, the clock signal CKV' is first switched to the transition level, and then to the low or high level, thereby achieving three-state output. This solution is applicable to clock signals having duty ratios other than 50%. This solution has the transition level provided by a power management IC 300. When the high or low voltage is varied, the transition level does not vary along with the high or low voltage and cannot be kept at one half of the sum of the high and low voltages. Its function in reducing power consumption and feedthrough effect as such cannot be maximized.

SUMMARY OF THE INVENTION

An objective of the present invention is to provide a GOA circuit driving method capable of keeping a transition level always at one half of a voltage difference of a high voltage source and a low voltage source and maximizing reduction of power consumption and feedthrough effect of the GOA circuit.

Another objective of the present invention is to provide a GOA circuit driving device capable of keeping a transition level always at one half of a voltage difference of a high voltage source and a low voltage and maximizing reduction of power consumption and feedthrough effect of the GOA circuit.

To achieve the above objectives, the present invention provides a GOA circuit driving method, comprising:

Step S1: providing a GOA circuit driving device, which comprises a timing controller, a level shift IC, and a buffer capacitor, wherein the timing controller is electrically connected to the level shift IC; a first terminal of the buffer capacitor is electrically connected to the level shift IC and a second terminal of the level shift IC is electrically connected to ground; and the level shift IC is electrically connected to the GOA circuit, and the level shift IC is fed with a high voltage source and a low voltage source;

Step S2: providing n initial clock signals from the timing controller to the level shift IC, n being a positive integer greater than or equal to 4; and Step S3: conducting level shifting to the n initial clock signals with the level shift IC to obtain n target clock signals, and providing the n target clock signals to the GOA circuit;

wherein the target clock signals have a high voltage source equal to the high voltage and a low voltage source equal to the low voltage source;

when the target clock signals are switched from the high voltage source to the low voltage source, the target clock signals are first switched from the high voltage source to being shorted with the buffer capacitor so that the target clock signals have a transition level and stay at the transition level for a preset first period, and are then switched from the transition level to the low voltage source;

when the target clock signals are switched from the low voltage source to the high voltage source, the target clock signals are first switched from the low voltage source to being shorted with the buffer capacitor so that the target clock signals have the transition level and stay at the transition level for the preset first period, and are then switched from the transition level to the high voltage source; and a value of the transition level is half of a voltage difference of the low voltage source and the high voltage source.

In step S2, the timing controller further provides a pulse width control signal to the level shift IC; and, in step S3, the first period is determined according to the pulse width control signal.

In step S2, the first period is equal to a pulse width of the pulse width control signal.

The GOA circuit driving device provided in step S1 further comprises a power management IC electrically connected to the level shift IC; and the level shift IC obtains the high voltage source and low voltage source from the power management IC.

The n initial clock signals have a duty ratio less than or equal to 50%; and the timing controller is electrically connected to the level shift IC through an I2C bus.

The present invention also provides a GOA circuit driving device, comprising a timing controller, a level shift IC, and a buffer capacitor, wherein the timing controller is electrically connected to the level shift IC; a first terminal of the buffer capacitor is electrically connected to the level shift IC and a second terminal of the buffer capacitor is electrically connected to ground; and the level shift IC is electrically connected to the GOA circuit, and the level shift IC is fed with a high voltage source and a low voltage source;

the timing controller provides n initial clock signals to the level shift IC, n being a positive integer greater than or equal to 4;

the level shift IC conducts level shifting to the n initial clock signals to obtain n target clock signals, and provides the n target clock signals to the GOA circuit;

the target clock signals have a high voltage source equal to the high voltage source and a low voltage source equal to the low voltage source; when the target clock signals are switched from the high voltage source to the low voltage source, the target clock signals are first switched from the high voltage source to being shorted with the buffer capacitor so that the target clock signals have a transition level and stay at the transition level for a preset first period, and are then switched from the transition level to the low voltage source; when the target clock signals are switched from the low voltage source to the high voltage source, the target clock signals are first switched from the low voltage source to being shorted with the buffer capacitor so that the target clock signals have the transition level and stay at the transition level for the preset first period, and are then switched from the transition level to the high voltage source; and a value of the transition level is half of a voltage difference of the low voltage source and the high voltage source.

The timing controller further provides a pulse width control signal to the level shift IC; and the level shift IC determines the first period according to the pulse width control signal.

The first period is equal to a pulse width of the pulse width control signal.

The GOA circuit driving device further comprises a power management IC electrically connected to the level shift IC, wherein the level shift IC obtains the high voltage source and the low voltage source from the power management IC.

The n initial clock signals have duty ratio less than or equal to 50%; and the TCON is electrically connected to the level shift IC through an I2C bus.

The advantages of the present invention are as follows. The present invention provides a GOA circuit driving method that, through the configuration of a buffer capacitor electrically connected to the level shift IC, the level shift IC stay at the transition level when shifting the target clock signals from high to low level or from low to high level. Through the buffer capacitor, the present invention is able to keep the transition level always equal to one half of the sum of the low voltage and the high voltage, thereby maximizing reduction of power consumption and feedthrough effect of the GOA circuit. The present invention also provides a GOA circuit driving device capable of maximizing reduction of power consumption and feedthrough effect of the GOA circuit.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

The following descriptions for the respective embodiments are specific embodiments capable of being implemented for illustrations of the present invention with referring to appended figures.

Figure 5:
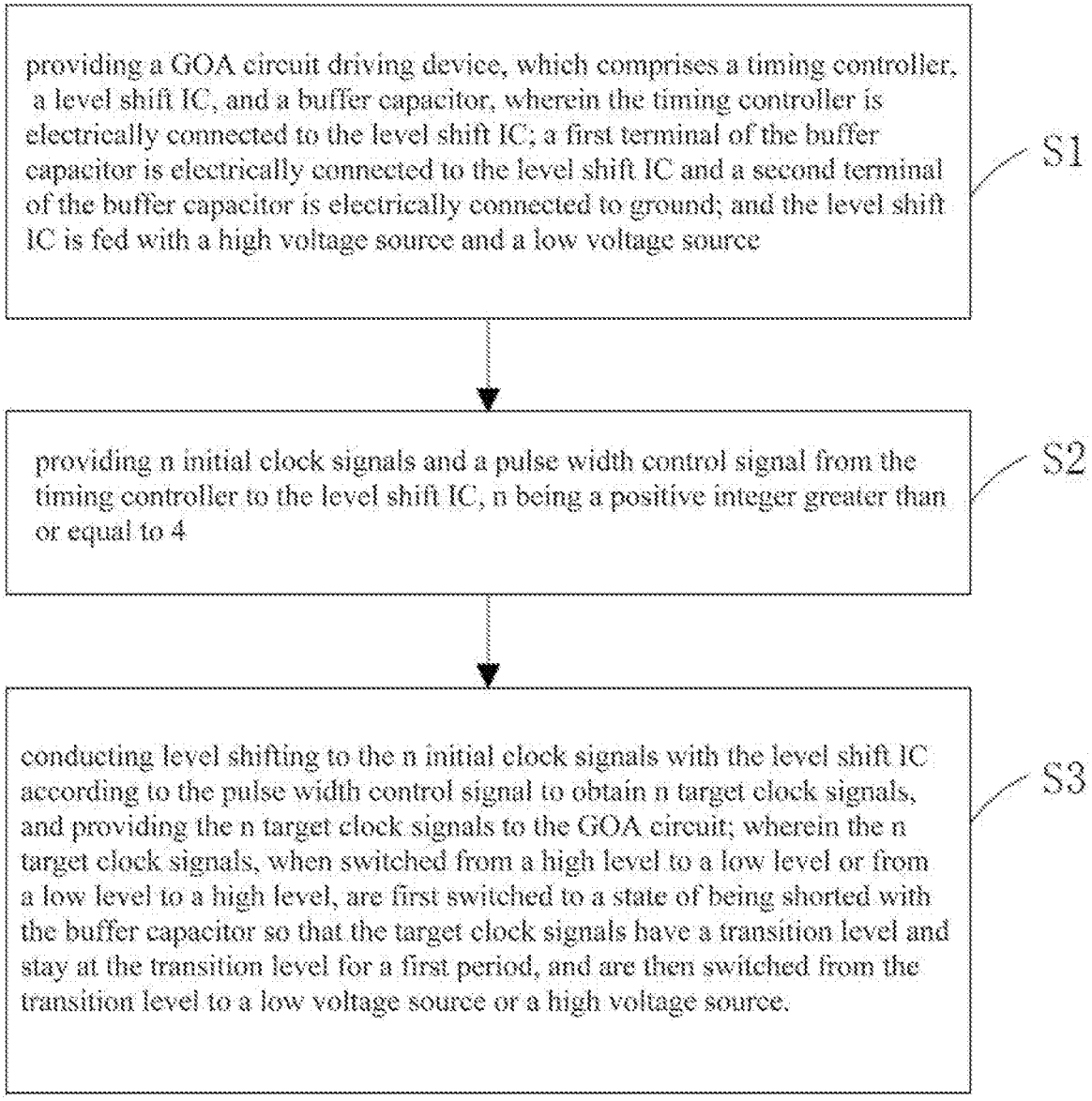
FIG. 5 is a flow diagram showing a GOA circuit driving method according to an embodiment of the present invention.

As shown in FIG. 5, a gate driver on array (GOA) circuit driving method according to the present invention includes the following steps.

Figure 1:
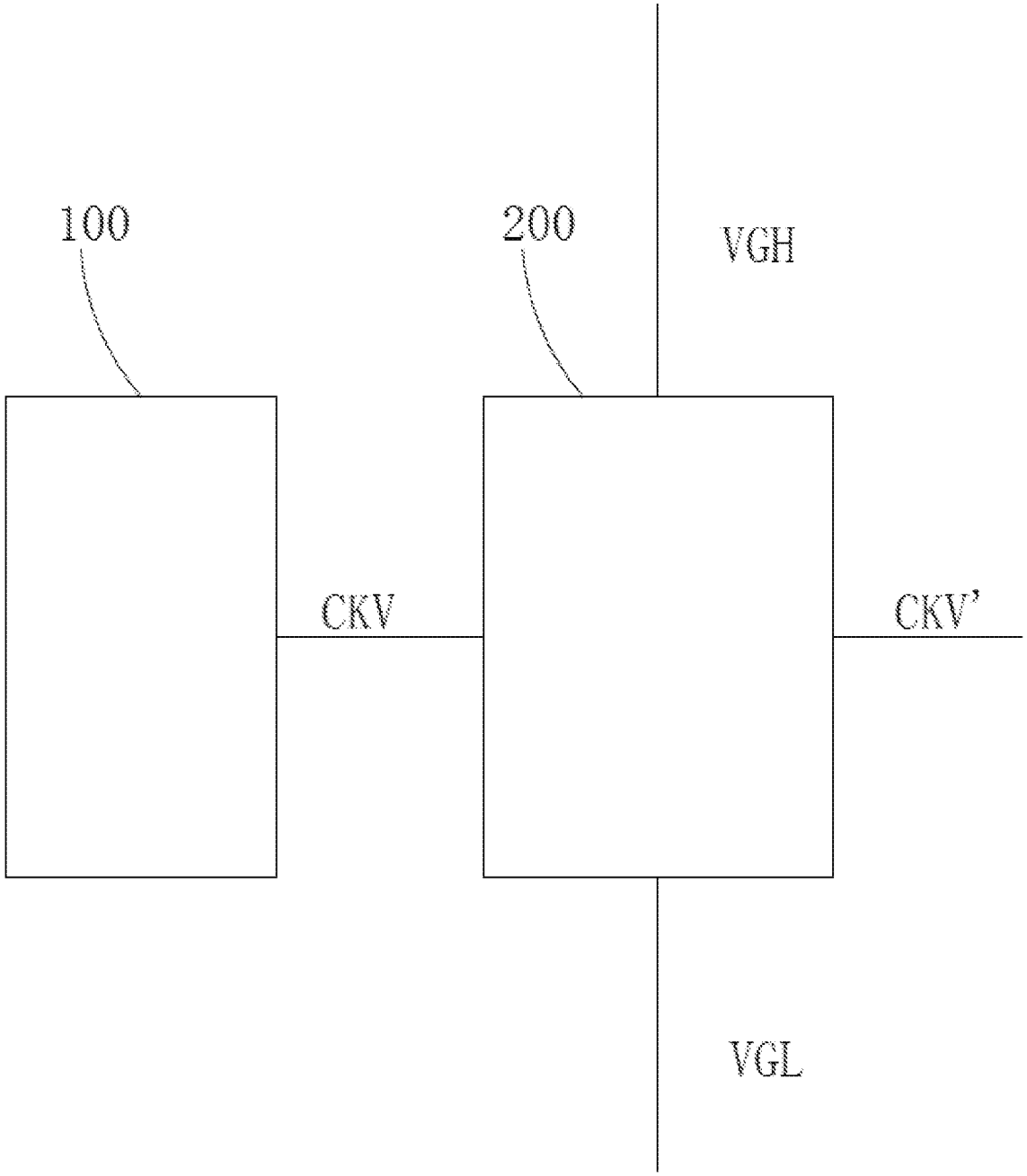
FIG. 1 (Prior art)
FIG. 1 is a schematic diagram showing an existing GOA circuit driving device.
Figure 2:
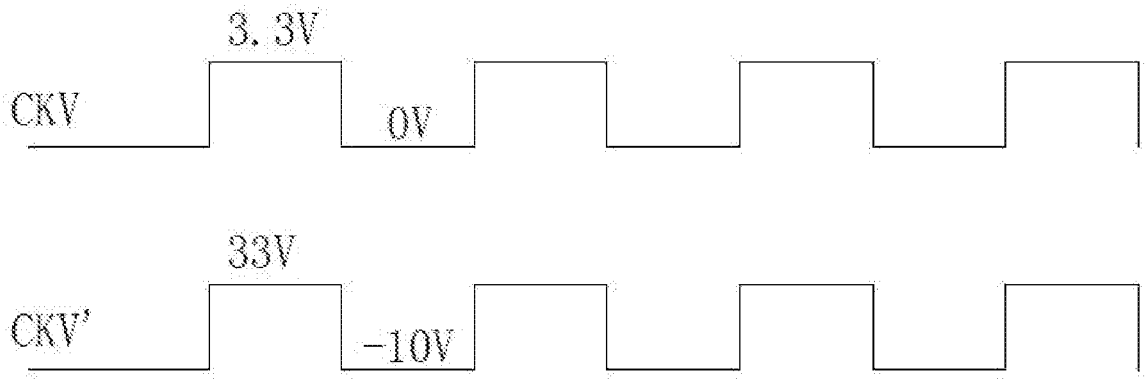
FIG. 2 (Prior art)
FIG. 2 is a timing diagram for an existing GOA circuit driving device.
Figure 3:
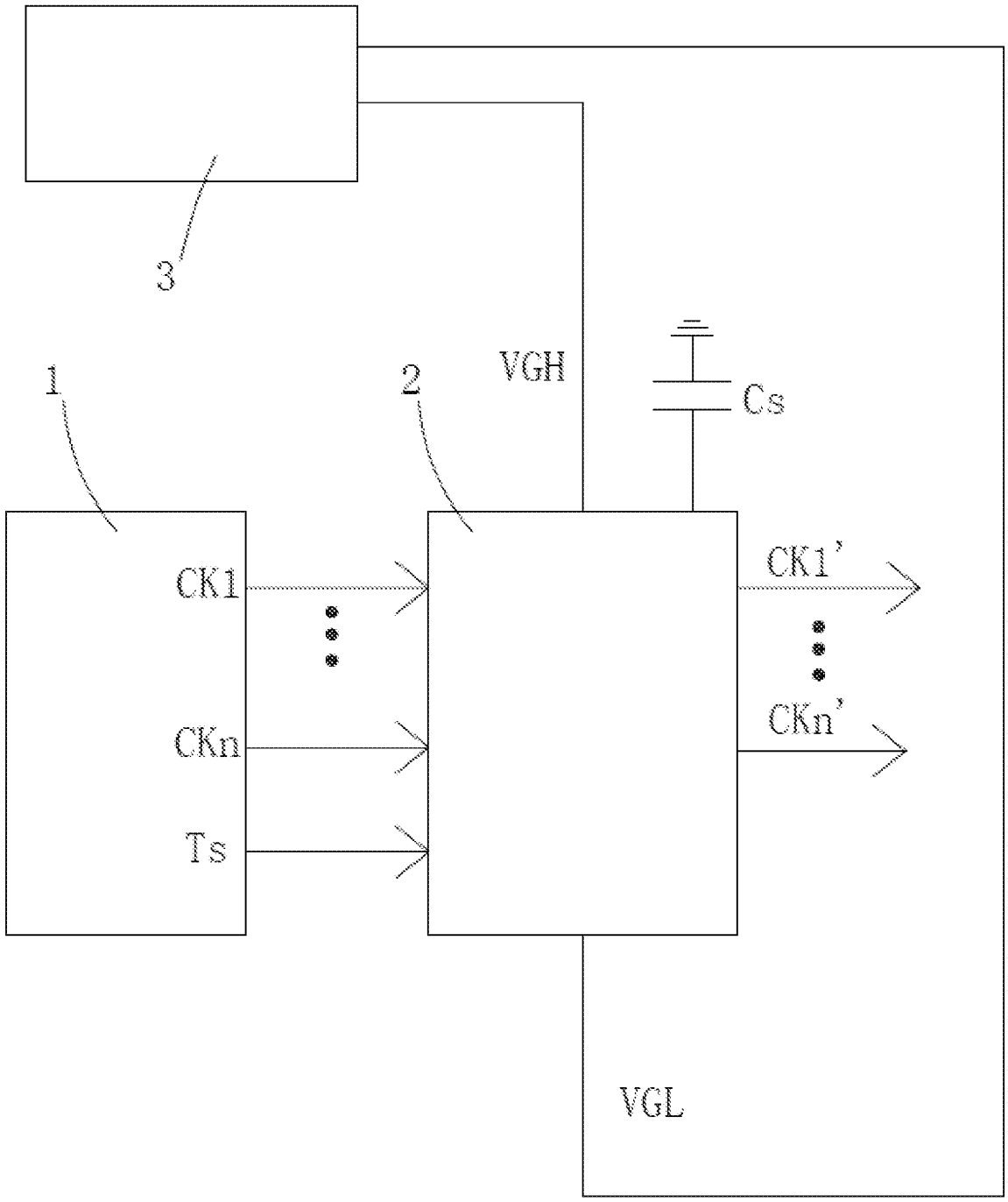
FIG. 3 is a schematic diagram showing a GOA circuit driving device according to an embodiment of the present invention.

Step S1: as shown in FIG. 3, providing a GOA circuit driving device, which includes a timing controller 1, a level shift IC 2, and a buffer capacitor Cs. The timing controller 1 is electrically connected to the level shift IC 2. A first terminal of the buffer capacitor Cs is electrically connected to the level shift IC 2 and a second terminal of the buffer capacitor Cs is electrically connected to ground. The level shift IC 2 is electrically connected to the GOA circuit.

The level shift IC 2 is electrically connected to a high voltage source VGH and a low voltage source VGL.

Specifically, the GOA circuit driving device also includes a power management IC 3 electrically connected to the level shift IC 2. The level shift IC 2 obtains the high voltage source VGH and the low voltage source VGL from the power management IC 3.

Preferably, the high voltage source VGH and the low voltage source VGL are 28V and −12.5V, respectively.

Preferably, the timing controller 1 and the level shift IC 2 are electrically connected together through an I2C bus. The I2C bus includes data lines SDA and clock signals SCL.

Step S2: providing initial clock signals Ck1-Ckn from the timing controller 1 to the level shift IC 2, n being a positive integer greater than or equal to 4.

Figure 4:
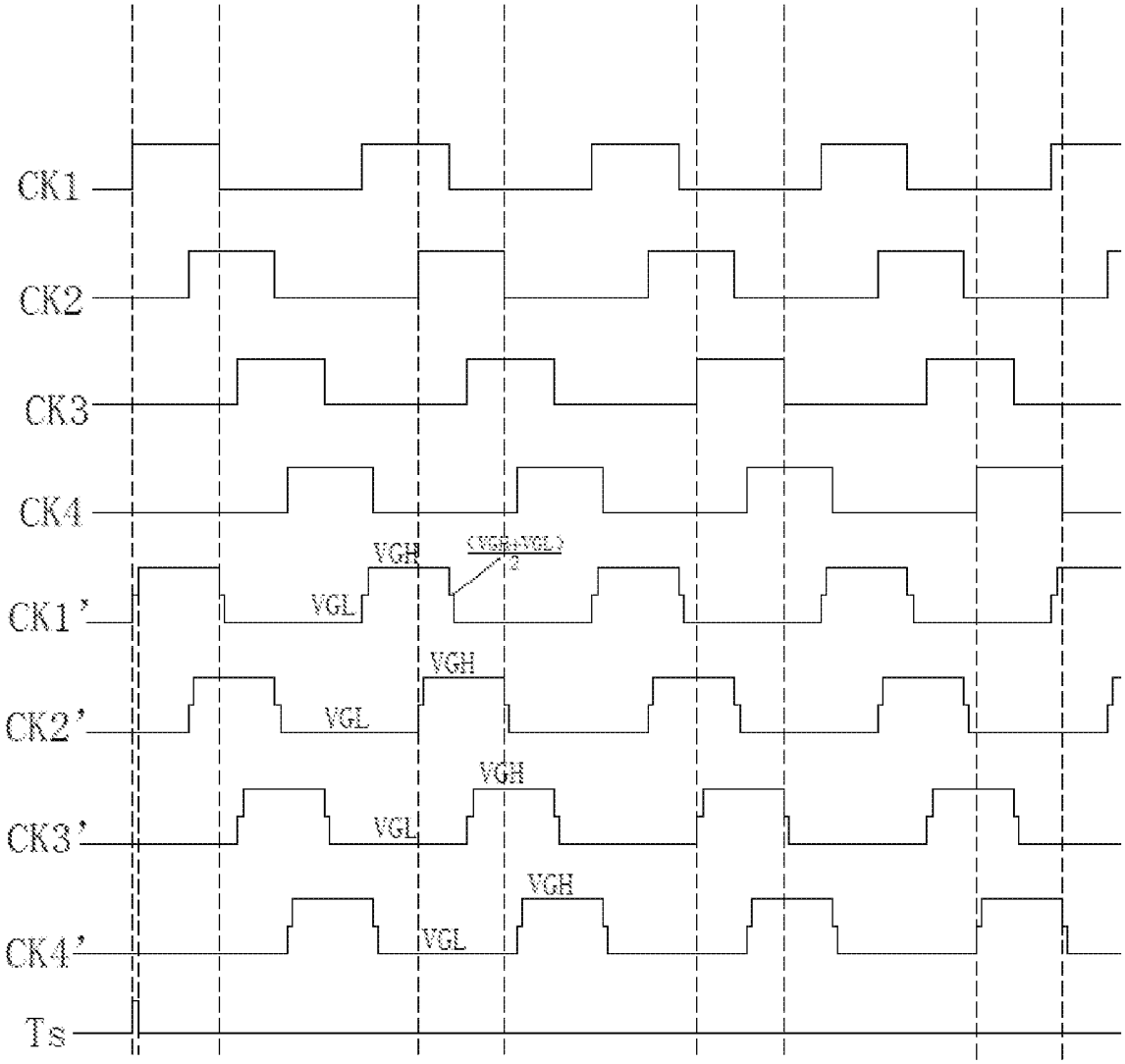
FIG. 4 is a timing diagram for the GOA circuit driving device of FIG. 3.

Specifically, as shown in FIG. 4, in an embodiment of the present invention, the timing controller 1 provides 4 initial clock signals to the level shift IC 2, namely, a first initial clock signal CK1, a second initial clock signal CK2, a third initial clock signal CK3, and a fourth initial clock signal CK4. The first initial clock signal CK1, the second initial clock signal CK2, the third initial clock signal CK3, and the fourth initial clock signal CK4 are sequentially provided in this order.

Preferably, the initial clock signals CK1, CK2, CK3, and CK4 have a high level of 3.3V on average and a low level of 0V on average. The duty ratios of the 4 initial clock signals CK1, CK2, CK3, and CK4 are less than or equal to 50%.

Step S3: conducting level shifting to the n initial clock signals Ck1-Ckn with the level shift IC 2 to obtain n target clock signals CK1'-Ckn', and providing the n target clock signal CK1'-CKn' to the GOA circuit.

The target clock signals CK1'-Ckn' have a high voltage source equal to the high voltage source VGH and a low voltage source equal to the low voltage source VGL. When the target clock signals CK1'-Ckn' are switched from high voltage source to low voltage source, they are first switched from the high voltage source VGH to being shorted with the buffer capacitor Cs so that the target clock signals CK1'-Ckn' have a transition level and stay at the transition level for a preset first period, and then switched from the transition level to the low voltage source VGL. When the target clock signals CK1'-Ckn' are switched from the low voltage source to the high voltage source, they are first switched from the low voltage VGL to being shorted with the buffer capacitor Cs so that the target clock signals CK1'-Ckn' have the transition level and stay at the transition level for the preset first period, and then switched from the transition level to the high voltage source VGL. A value of the transition level is half of the sum of the low voltage source VGL and the high voltage source VGH.

Specifically, as shown in FIG. 4, the first, second, third, and fourth initial clock signal CK1, CK2, CK3, and CK4 respectively become the first, second, third, and fourth target clock signal CK1', CK2', CK3', and CK4' after the level shifting. When the first to fourth target clock signals CK1'-CK4' are switched from the high voltage source to the low voltage source, they are first switched to being shorted with the buffer capacitor Cs so that the first to fourth target clock signals CK1'-CK4' charge the buffer capacitor Cs and the first to fourth target clock signals CK1'-CK4' are lowered to the transition level, which is half of a voltage difference of the low voltage source VGL and the high voltage source VGH, and are kept for the first period. They are then switched to the low voltage source. When they are switched from the low voltage source to the high voltage source, they are also first switched to being shorted with the buffer capacitor Cs so that the first to fourth target clock signals CK1'-CK4' are charged by the buffer capacitor Cs and the first to fourth target clock signals CK1'-CK4' are raised to the transition level, which is half of the voltage difference of the low voltage source VGL and the high voltage source VGH, and are kept for the first period. They are then switched to the high voltage source. The first to fourth target clock signals CK1'-CK4' have falling edges from the high level to the transition voltage source VAA corresponding to the falling edges of the first to fourth initial clock signals CK1-CK4. The first to fourth target clock signals CK1'-CK4' have rising edges from the low level to the transition voltage source corresponding to the rising edges of the first to fourth initial clock signals CK1-CK4.

It should be noted that that, through the buffer capacitor Cs, the present invention keeps the transition level always equal to one half of a voltage difference of the low voltage source VGL and the high voltage source VGH without being affected by the variation of the low voltage source VGL and the high voltage source VGH, thereby maximizing reduction of the power consumption and feedthrough effect of the GOA circuit.

Furthermore, the high voltage source VGH and the low voltage source VGL are respectively 28V and −12.5V. According to the GOA circuit power consumption equation, after being processed with the level shifting method of the present invention, the GOA circuit would have a power consumption P=40.5I, where I is the driving current. In contrast, in the prior art, by taking an example where the high voltage source VGH and the low voltage source VGL are respectively 28V and −12.5V, and the transition level VAA is equal to 15 V, the GOA circuit has a power consumption P=81I. Therefore, through the present invention, the power consumption of the GOA circuit is reduced for 50%.

Therefore, the present invention is able to significantly reduce the power consumption and feedthrough voltage of the GOA circuit. In contrast to the prior art charge sharing technique, the present invention obtains the transition level through a buffer capacitor electrically connected to the level shift IC and does not require shorting of the clock signals and therefore is not limited by the duty ratio of the clock signals, thereby achieving greater applicability. Compared to the existing method in which a power management IC is supplied with a transition level VAA, the present invention is able to keep the transition level always equal to one half of a voltage difference of the low voltage source VGL and the high voltage source VGH, thereby always keeping maximization of reduction of power consumption and feedthrough effect of the GOA circuit.

Furthermore, in step S2, the the timing controller 1 of step S2 further provides a pulse width control signal Ts to the level shift IC 2. Then, in step S3, the first period is determined according to the pulse width control signal Ts, so that through adjusting signal parameters of the pulse width control signal Ts, the first period over which the clock signals stay at the transition level may be adjusted, thereby enhancing the adjustment flexibility of the clock signals.

Preferably, the first period has a length equal to the pulse width of the pulse width control signal Ts. The pulse width control signal Ts is transmitted through data lines SDA and clock signal lines SCL of an I2C bus.

Referring to FIG. 3, the present invention also provides a GOA circuit driving device which includes a timing controller 1, a level shift IC 2, and a buffer capacitor Cs. The Timing controller 1 is electrically connected to the level shift IC 2. A first terminal of the buffer capacitor Cs is electrically connected to the level shift IC 2 and a second terminal of the buffer capacitor Cs is electrically connected to ground. The level shift IC 2 is electrically connected to the GOA circuit.

The level shift IC 2 is electrically connected to a high voltage source VGH and a low voltage source VGL.

The timing controller 1 provides n initial clock signals Ck1-Ckn to the level shift IC 2, n being a positive integer greater than or equal to 4.

The level shift IC 2 conducts level shifting to the n initial clock signals Ck1-Ckn to obtain n target clock signals CK1'-Ckn', and provides the n target clock signals CK1'-Ckn' to the GOA circuit.

The target clock signals CK1'-Ckn' have a high voltage source equal to the high voltage source VGH and a low voltage source equal to the low voltage source VGL. When the target clock signals CK1'-Ckn' are switched from the high voltage source to the low voltage source, they are first switched from the high voltage source VGH to being shorted with the buffer capacitor Cs so that the target clock signals CK1'-Ckn' have a transition level and stay at the transition level for a preset first period, and then switched from the transition level to the low voltage source VGL. When the target clock signals CK1'-Ckn' are switched from the low voltage source to the high voltage source, they are first switched from the low voltage source VGL to being shorted with the buffer capacitor Cs so that the target clock signals CK1'-Ckn' have the transition level and stay at the transition level for the preset first period, and then switched from the transition level to the high voltage source VGL.

The transition level is half of a voltage difference of the low voltage source VGL and the high voltage source VGH.

Specifically, as shown in FIG. 3, the GOA circuit driving device also includes a power management IC 3 electrically connected to the level shift IC 2. The level shift IC 2 obtains the high voltage source VGH and the low voltage source VGL from the power management IC 3.

Preferably, the high voltage source VGH and the low voltage source VGL are 28V and −12.5V, respectively.

Preferably, the timing controller 1 and the level shift IC 2 are electrically connected together through an I2C bus. The I2C bus includes data lines SDA and clock signals SCL.

Specifically, as shown in FIG. 4, in an embodiment of the present invention, the timing controller 1 provides 4 initial clock signals to the level shift IC 2, namely, a first initial clock signal CK1, a second initial clock signal CK2, a third initial clock signal CK3, and a fourth initial clock signal CK4. The first initial clock signal CK1, the second initial clock signal CK2, the third initial clock signal CK3, and the fourth initial clock signal CK4 are sequentially provided in this order.

Preferably, the first initial clock signal CK1, the second initial clock signal CK2, the third initial clock signal CK3, and the fourth initial clock signal CK4 have a high level of 3.3V on average and a low level of 0V on average. The duty ratios of the 4 initial clock signals CK1, CK2, CK3, and CK4 are less than or equal to 50%.

Furthermore, as shown in FIG. 4, the first initial clock signal CK1, the second initial clock signal CK2, the third initial clock signal CK3, and fourth initial clock signal CK4 respectively become first target clock signal CK1', second target clock signal CK2', third target clock signal CK3', and fourth target clock signal CK4'. When the first to fourth target clock signals CK1'-CK4' are switched from the high voltage source to the low voltage source, they are first switched to being shorted with the buffer capacitor Cs so that the first to fourth target clock signals CK1'-CK4' charge the buffer capacitor Cs and the first to fourth target clock signals CK1'-CK4' are lowered to the transition level, which is half of a voltage difference of the low voltage source VGL and the high voltage source VGH, and are kept for the first period, and are finally switched to the low voltage source. When they are switched from the low voltage source to the high voltage source, they are also first switched to being shorted with the buffer capacitor Cs so that the first to fourth target clock signals CK1'-CK4' are charged by the buffer capacitor Cs and the first to fourth target clock signals CK1'-CK4' are raised to the transition level, which is half of the voltage difference of the low voltage source VGL and the high voltage source VGH, and are kept for the first period, and are finally switched to the high voltage source. The first to fourth target clock signals CK1'-CK4' have falling edges from the high level to the transition voltage source VAA corresponding to the falling edges of the first to fourth initial clock signals CK1-CK4. The first to fourth target clock signals CK1'-CK4' have rising edges from the low level to the transition voltage source corresponding to the rising edges of the first to fourth initial clock signals CK1-CK4.

It should be noted that that, through the buffer capacitor Cs, the present invention keeps the transition level always equal to one half of a voltage difference of the low voltage source VGL and the high voltage source VGH without being affected by the variation of the low voltage source VGL and the high voltage source VGH, thereby maximizing reduction of the power consumption and feedthrough effect of the GOA circuit.

Furthermore, the high voltage source VGH and the low voltage source VGL are respectively 28V and −12.5V. According to the GOA circuit power consumption equation, after being processed with the level shifting method of the present invention, the GOA circuit would have a power consumption P=40.5I, where I is the driving current. In contrast, in the prior art, by taking an example where the high voltage source VGH and the low voltage source VGL are respectively 28V and −12.5V, and the transition level VAA is equal to 15 V, the GOA circuit has a power consumption P=81I. Therefore, through the present invention, the power consumption of the GOA circuit is reduced for 50%.

Therefore, the present invention is able to significantly reduce the power consumption and feedthrough voltage of the GOA circuit. In contrast to the prior art charge sharing technique, the present invention obtains the transition level through a buffer capacitor electrically connected to the level shift IC and does not require shorting of the clock signals and therefore is not limited by the duty ratio of the clock signals, thereby achieving greater applicability. Compared to the existing method in which a power management IC is supplied with a transition level VAA, the present invention is able to keep the transition level always equal to one half of a voltage difference of the low voltage source VGL and the high voltage source VGH, thereby always keeping maximization of reduction of power consumption and feedthrough effect of the GOA circuit.

Furthermore, the timing controller 1 further provides a pulse width control signal Ts to the level shift IC 2. Then the level shift IC 2 determines the first period according to the pulse width control signal Ts, so that through adjusting signal parameters of the pulse width control signal Ts, the first period over which the clock signals stay at the transition level may be adjusted, thereby enhancing the adjustment flexibility of the clock signals.

Preferably, the first period has a length equal to the pulse width of the pulse width control signal Ts. The pulse width control signal Ts is transmitted through data lines SDA and clock signal lines SCL of an I2C bus.

As described above, the present invention provides a GOA circuit driving method that, through adding a buffer capacitor electrically connected to the level shift IC, the level shift IC stays at the transition level when shifting the target clock signals from high to low level or from low to high level. Through the buffer capacitor, the present invention is able to keep the transition level always equal to one half of the sum of the low voltage VGL and the high voltage VGH, thereby maximizing reduction of power consumption and feedthrough effect of the GOA circuit. The present invention also provides a GOA circuit driving device capable of maximizing reduction of power consumption and feedthrough effect of the GOA circuit.

Above are embodiments of the present invention, which does not limit the scope of the present invention. Any equivalent amendments within the spirit and principles of the embodiment described above should be covered by the protected scope of the invention.

What is claimed is:

1. A driving method of a Gate Drive on Array (GOA) circuit, comprising:

Step S1: providing a GOA circuit driving device, which comprises a timing controller, a level shift IC, and a buffer capacitor, wherein the timing controller is electrically connected to the level shift IC; a first terminal of the buffer capacitor is electrically connected to the level shift IC and a second terminal of the buffer capacitor is electrically connected to ground; and the level shift IC is electrically connected to the GOA circuit, and the level shift IC is fed with a high voltage source and a low voltage source;

Step S2: providing n initial clock signals from the timing controller to the level shift IC, n being a positive integer greater than or equal to 4; and Step S3: conducting level shifting to the n initial clock signals with the level shift IC to obtain n target clock signals, and providing the n target clock signals to the GOA circuit;

wherein the target clock signals have a high voltage source equal to the high voltage source and a low voltage source equal to the low voltage source;

when the target clock signals are switched from the high voltage source to the low voltage source, the target clock signals are first switched from the high voltage source to being shorted with the buffer capacitor so that the target clock signals have a transition level and stay at the transition level for a preset first period, and are then switched from the transition level to the low voltage source;

when the target clock signals are switched from the low voltage source to high voltage source, the target clock signals are first switched from the low voltage source to being shorted with the buffer capacitor so that the target clock signals have the transition level and stay at the transition level for the preset first period, and are then switched from the transition level to the high voltage source; and a value of the transition level is half of a voltage difference of the low voltage source and the high voltage source;

wherein the first terminal of the buffer capacitor is directly connected to the level shift IC such that the target clock signals are selectively shorted with the buffer capacitor and the buffer capacitor keeps the transition level constantly equal to one half of the voltage difference between the low voltage source and the high voltage source regardless variation of the low and high voltage sources.

2. The driving method of a GOA circuit according to claim 1, wherein, in step S2, the timing controller further provides a pulse width control signal to the level shift IC; and, in step S3, the first period is determined according to the pulse width control signal.

3. The driving method of a GOA circuit according to claim 2, wherein, in step S2, the first period is equal to a pulse width of the pulse width control signal.

4. The driving method of a GOA circuit according to claim 1, wherein the GOA circuit driving device provided in step S1 further comprises a power management IC electrically connected to the level shift IC; and the level shift IC obtains the high voltage source and low voltage source from the power management IC.

5. The driving method of a GOA circuit according to claim 1, wherein the n initial clock signals have a duty ratio less than or equal to 50%; and the timing controller is electrically connected to the level shift IC through an I2C bus.

6. A driving device of a GOA circuit, comprising a timing controller, a level shift IC, and a buffer capacitor, wherein the timing controller is electrically connected to the level shift IC; a first terminal of the buffer capacitor is electrically connected to the level shift IC and a second terminal of the level shift IC is electrically connected to ground; and the level shift IC is electrically connected to the GOA circuit, and the level shift IC is fed with a high voltage source and a low voltage source;

the timing controller provides n initial clock signals to the level shift IC, n being a positive integer greater than or equal to 4;

the level shift IC conducts level shifting to the n initial clock signals to obtain n target clock signals, and provides the n target clock signals to the GOA circuit;

the target clock signals have a high voltage source equal to the high voltage and a low voltage source equal to the low voltage; when the target clock signals are switched from the high voltage source to the low voltage source, the target clock signals are first switched from the high voltage source to being shorted with the buffer capacitor so that the target clock signals have a transition level and stay at the transition level for a preset first period, and are then switched from the transition level to the low voltage source; when the target clock signals are switched from the low voltage source to high voltage source, the target clock signals are first switched from the low voltage source to being shorted with the buffer capacitor so that the target clock signals have the transition level and stay at the transition level for the preset first period, and are then switched from the transition level to the high voltage source; and a value of the transition level is half of a voltage difference of the low voltage source and the high voltage source;

wherein the first terminal of the buffer capacitor is directly connected to the level shift IC such that the target clock signals are selectively shorted with the buffer capacitor and the buffer capacitor keeps the transition level constantly equal to one half of the voltage difference between the low voltage source and the high voltage source regardless variation of the low and high voltage sources.

7. The driving device according to claim 6, wherein the timing controller further provides a pulse width control signal to the level shift IC; and the level shift IC determines the first period according to the pulse width control signal.

8. The driving device according to claim 7, wherein the first period is equal to a pulse width of the pulse width control signal.

9. The driving device according to claim 6, further comprising a power management IC electrically connected to the level shift IC, wherein the level shift IC obtains the high voltage source and low voltage source from the power management IC.

10. The driving device according to claim 6, wherein the n initial clock signals have a duty ratio less than or equal to 50%; and the timing controller is electrically connected to the level shift IC through an I2C bus.

* * * * *